United States Patent [19]

Ishino et al.

[11] Patent Number: 4,689,460

[45] Date of Patent: Aug. 25, 1987

[54] ABSORBER DEVICE FOR MICROWAVE LEAKAGE

[75] Inventors: Ken Ishino; Yasuo Hashimoto; Katuhiko Hayashi; Nobutaka Misawa, all of Chiba, Japan

[73] Assignee: TDK Corporation, Tokyo, Japan

[21] Appl. No.: 812,961

[22] Filed: Dec. 24, 1985

[30] Foreign Application Priority Data

Jan. 4, 1985 [JP] Japan ..... 60-000005[U]
Oct. 23, 1985 [JP] Japan ..... 60-162635[U]
Oct. 23, 1985 [JP] Japan ..... 60-162636[U]

[51] Int. Cl.[4] ..... H05B 6/76
[52] U.S. Cl. ..... 219/10.55 D; 174/35 GC
[58] Field of Search ..... 219/10.55 D, 10.55 R; 174/35 GC, 35 MS, 35 R

[56] References Cited

U.S. PATENT DOCUMENTS 3,633,564 1/1972 Togashi et al. ..... 219/10.55 D
3,742,176 6/1973 Ishino et al. ..... 219/10.55 D
3,809,843 5/1974 Takayama ..... 219/10.55 D
4,046,983 9/1977 Ishino et al. ..... 219/10.55 D
4,347,420 8/1982 Ikeda et al. ..... 219/10.55 D
4,475,023 10/1984 Iwabuchi et al. ..... 219/10.55 D
4,523,069 6/1985 Staats ..... 219/10.55 D
4,525,614 6/1985 Ishino et al. ..... 219/10.55 D

*Primary Examiner*—Philip H. Leung
*Attorney, Agent, or Firm*—Martin M. Novack

[57] ABSTRACT

A microwave absorber device for a microwave heater having a chamber for cooking with an opening, and a door for closing the opening with a small gap which is a leakage path between the door and the wall of the chamber. The door is provided with a choke cavity at the peripheral portions of the same, the choke cavity having an approximate ¼ wavelength of length, and an entrance facing the leakage path. The choke cavity is provided with wave absorber which includes ferrite, and/or carbon, at an edge of the entrance or an edge of the cavity. The wave absorber closes also the leakage path. The entrance itself is sealed by dielectric material.

15 Claims, 16 Drawing Figures

Fig. 5
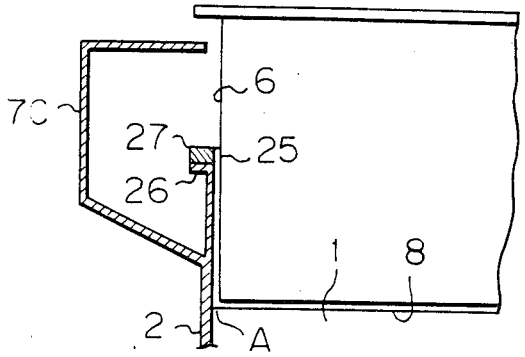
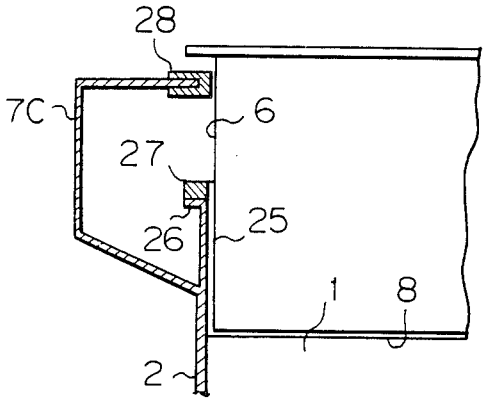
Fig. 6
Fig. 7
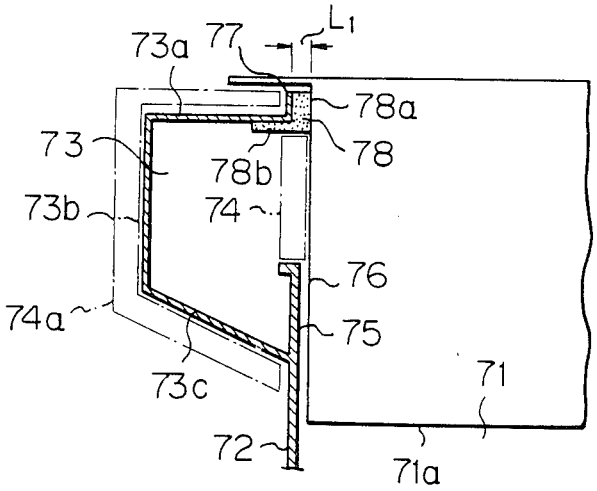

ABSORBER DEVICE FOR MICROWAVE LEAKAGE

BACKGROUND OF THE INVENTION

The present invention relates to the improvement of an electro-magnetic wave absorber device, or the improvement of a device for preventing the leakage of waves. The present invention is used, for instance, for preventing leakage of wave energy in a microwave heater, for example, a microwave oven.

Conventionally, an absorber device for microwave leakage in a microwave oven has three absorber means. The first one is a metal contact spring which provides the conductive contact between the body and the door to close the door completely. The second one is a choke cavity with $\frac{1}{4}$ wavelength for absorbing waves which leak through said conductive contact. The third one is a ferrite absorber provided at the outlet of the leakage path for absorbing the rest of the leakage.

The present applicant obtained the U.S. Pat. No. 4,525,614 (the corresponding UK Pat. No. 2 122 059, French Pat. No. 82 19333, German Pat. No. 32 42 125). That patent has the feature that the opening of the choke cavity is covered with ferrite material. That patent is excellent as far as the fundamental oscillation frequency (2450 MHz) of a microwave oven concerned.

However, it has been lately become desirable that not only the fundamental frequency but also the harmonic frequencies (for instance the frequency around 12 GHz) are sufficiently attenuated so that a satellite broadcast is not disturbed by a microwave oven. Further, the high frequency noise between 1 GHz and 18 GHz is subject to control.

Accordingly, the leakage of not only the fundamental frequency but also the harmonics must be prevented.

A prior choke cavity which resonates with the fundamental frequency is useless to prevent the subsequent harmonics.

SUMMARY OF THE INVENTION

It is an object of the present invention to overcome the disadvantages and limitations of a prior electro-magnetic wave absorber device by providing a new and improved absorber device.

It is also an object of the present invention to provide an electro-magnetic wave absorber device which is effective not only for the fundamental frequency but also for the harmonic frequencies.

The above and other objects are attained by an electro-magnetic wave absorber device comprising a chamber in which food to be cooked is put; a door for closing an opening of said chamber made of electro-magnetic shielding material; a cavity provided at peripheral portions of said door so that an opening of said cavity faces with a wall of the chamber; said cavity being provided with a wave absorber at an edge of a wall of the cavity so that a gap between the door and the wall of the chamber is closed by said wave absorber, and said wave absorber is comprised of ferrite powder.

BRIEF DESCRIPTION OF THE DRAWINGS

The foregoing and other objects, features, and attendant advantages of the present invention will be appreciated as the same become better understood by means of the following description and accompanying drawings wherein;

FIG. 5 is a cross section of still another embodiment according to the present invention, FIG. 6 is a cross section of still another embodiment according to the present invention, FIG. 7 is a cross section of still another embodiment according to the present invention.

DESCRIPTION OF THE PREFERRED EMBODIMENTS

Figure 1:
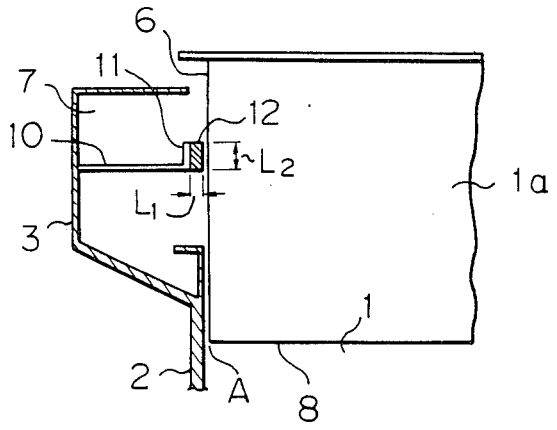
FIG. 1 shows a cross section of the wave absorber according to the present invention.
Figure 2:
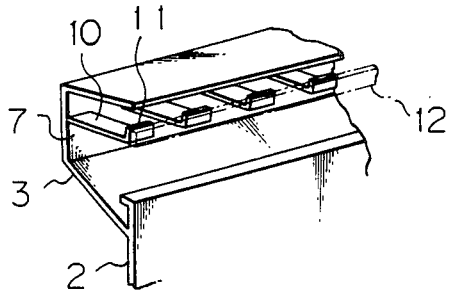
FIG. 2 shows a perspective view of the structure of FIG. 1.

FIG. 1 shows the cross section of the wave absorber device according to the present invention, and FIG. 2 is the perspective view of FIG. 1. In those figures, the reference numeral 1 is a chamber in which food is cooked. The numeral 1*a* is a wall which encloses the chamber 1 except of a front opening which is closed by a door 2. Of course, the door 2 may open and/or close the chamber 1. The door 2 is provided with a frame 3 at the peripheral portion of the door 2. The frame 3 faces with the end 6 of the wall 1*a* with a small gap.

Said frame 3 has a choke cavity 7 which resonates with the length approximately $\frac{1}{4}$ wavelength of the fundamental frequency of a magnetron oscillator. The cavity 7 has, in the present embodiment, a plurality of periorically spaced tines 10 which function to shorten the length of the cavity, and widen the operational frequency band of the cavity.

The cavity 7 attenuates energy of microwaves which leak through the gap between the chamber wall and the door from the point A at the inner surface 8 of the wall 1*a*.

The basic idea of the present invention is to mount a wave absorber at the portion where the flux density is high in a cavity. In our analysis, the flux density at the edge of the tines 10 is maximum in the cavity 7, therefore the folded flanges 11 are provided at the end of the tines 10, and on said flanges 11, a longitudinal elastic single wave absorber member 12 which bridges a plurality of tines is mounted as shown by the dotted line in FIG. 2. The absorber member 12 is made of the mixture of (ferrite powder and/or carbonil iron powder), and (plastics, and/or natural gum), or the mixture of the above mixture and carbon powder.

The wave absorber 12 contacts with the end 6 of the wall 1*a*, or at least faces with said end 6 with a small gap which is far less than the wavelength of 12 GHz, when the door is closed so that the cavity 1 is electrically and magnetically closed completely. In the preferred embodiment, the thickness $L_1$ of the wave absorber is in the range between 1 mm and 2 mm, and the width $L_2$ of the wave absorber is in the range between 6 mm and 8 mm.

In the above structure, the length of the cavity is $\frac{1}{4}$ wavelenth, and so, the fundamental microwave frequency which leaks from the point A at the corner of the chamber is considerably attenuated.

As the wave absorber 12 is mounted at the extreme edge of the tines 10, the leakage of the waves from the cavity 7 is attenuated. It should be appreciated that the wave absorber is in particular effective as it is mounted at the portion where the flux is at peak value in the cavity. The wave absorber is effective not only for the attenuation of the fundamental frequency (2450 MHz), but also the attenuation of the harmonics up to 12 GHz. Thus, the noise from a microwave oven which could affect satellite communication is effectively attenuated.

Figure 3:
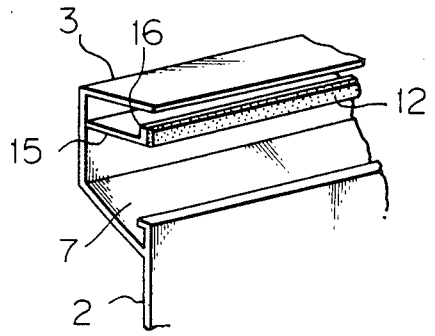
FIG. 3 is a perspective view of another embodiment of the present invention.

FIG. 3 is the modification of the structure of FIG. 2. The feature of FIG. 3 is the use of an intermediate conductive plate 15 instead of a plurality of periodic tines 10 of FIG. 2. The intermediate plate 15 has a folded portion at the extreme end of the same, and at that folded portion, a longitudinal wave absorber 12 is attached. Preferably, the wave absorber is elastic so that the gap between the chamber and the door is completely closed.

Figure 4:
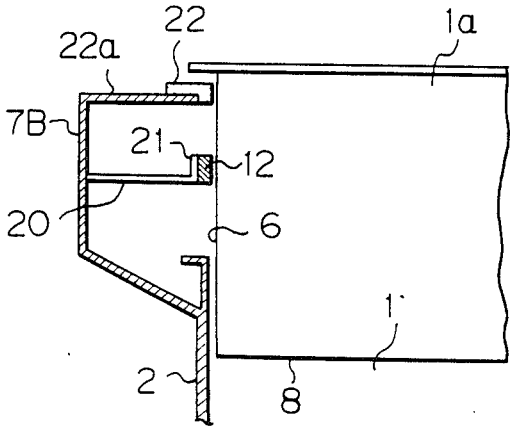
FIG. 4 is a cross section of still another embodiment according to the present invention.

FIG. 4 is another embodiment of the present invention. In the figure, the cavity 7B at the peripheral portion of the door 2 has the intermediate conductor 20 which may be composed of a plurality of tines like FIG. 2, or a bulk plate like FIG. 3. The conductor 20 has the folded portion at the extreme end of a same, and the wave absorber 12 is mounted at said folded portion. Further, in the embodiment of FIG. 4, the second wave absorber 22 which is made of the same material as that of the absorber 12 is attached at the edge of the external wall **22*a* of the cavity 7B. The wave absorber 22 contacts directly with the wall 1*a* or at least faces with the wall 1*a*** with the small gap as compared with the wavelength of 12 GHz.

The embodiment of FIG. 4 is very effective to attenuate the leakage of wave energy, since the wave absorber is attached not only at the edge of the intermediate conductor 20, but also at the edge of the external wall **22*a*** of the cavity.

FIG. 5 is still another embodiment of the present invention. The important feature of the embodiment of FIG. 5 is the location of the wave absorber 27 which is mounted at the edge of the inner wall of the cavity 7C. In the embodiment of FIG. 5, the conductive frame 25 which is the inner wall of the chamber 1 extends to the side 6. That conductive frame 25 contacts with the wall of the cavity 7C which is mounted at the peripheral portion of the door 2. The length of the cavity 7C is approximately $\frac{1}{4}$ wavelength of the fundamental frequency. In the embodiment of FIG. 5, the intermediate plate or the intermediate tines is not provided. However, it should be noted that the absence of the intermediate plate is not the important feature of the embodiment, and that intermediate plate may also be mounted in the cavity.

The cavity 7C has a opening which faces with the wall 6 of the chamber 1. The inner wall of the cavity 7C has the fold 26, to which the wave absorber 27 is attached. The wave absorber 27 contacts essentially with the wall 6 or 25 of the chamber 1 so that the gap between the chamber and the door is closed. It should be noted that the flux density is at the peak value at the edge of the inner wall, or the folded portion 26, therefore, the wave absorber 27 which is located at the portion where the flux density is at peak value attenuates substantially not only the fundamental frequency but also the harmonic frequencies.

FIG. 6 is the modification of the embodiment of FIG. 5. The feature of FIG. 6 is the presence of the additional wave absorber 28 at the edge of the outer wall of the cavity 7C.

As described above, according to the present invention, wave absorbers are mounted at an edge of a cavity, and the entrance or the opening of the cavity is closed by non-magnetic material like plastics, or said entrance is even open. It is preferable that an entrance of a cavity is sealed by dielectric material so that dust collecting in a cavity is prevented. The wave absorber is mounted at the portion where the flux density in the cavity is at the peak value. In a pratical embodiment, the wave absorber is mounted at the edge of an intermediate conductor (FIGS. 1 through 3), or at the edge of an outer wall of a cavity (FIGS. 4 and 6), or at the edge of an inner wall of a cavity (FIGS. 5 and 6). The wave absorber may be mounted at two edges (FIGS. 4 and 6), or the wave absorber may even be mounted at three edges (outer wall, intermediate plate, and inner wall). When the wave absorber is mounted at many points of a cavity, the effect of attenuation of leakage is high, so, the number of waves absorbed is the trade-off between the cost of a device and the required attenuation of leakage. In our experiment, one or two absorbers are enough for a microwave oven which does not disturb satellite communication.

FIG. 7 is a cross section of still another embodiment of the present invention. The important feature of the embodiment of FIG. 7 is that the wave absorber is located not only at the edge of the cavity wall, but also at the inside of the cavity.

In FIG. 7, the chamber 71 for putting food to be cooked has a frame with the wall **71*a*. The chamber 71 has the opening which is closed by a door 72. The door 72 has the conductive shield mesh on the opening, therefore, no wave energy leaks through the opening. The leakage path is the small gap between the wall 75 of the door 72 and the wall 76 of the chamber 71. The leakage through said small gap is attenuated by the cavity 73 located at the peripheral portion of the door 72**, and the wave absorber according to the present invention.

The cavity 73 has the elongated empty space which is closed by the first outer wall **73*a* which is perpendicular to the door 72 at the extreme end of the door 72, the second wall 73*b* which is parallel to the door 72 and is coupled with said first wall 73*a*, and the third inner wall 73*c* which is provided between said second wall 73*b* and the door 72, and the wall 75 of the door 72. The opening is closed by the closing member 74 made of dielectric material, like plastics. The whole body of the cavity 73 is covered with the dielectric cover 74*a***.

The first wall **73*a* at the extreme end of the cavity 73 has the folded flange 77 at the edge of the wall 73*a*, and the wave absorber 78 is attached to the folded flange 77 and the inner wall of the wall 73*a*. The wave absorber 78 is elongated, and is L-shaped, having the first arm 78*a*, and the second arm 78*b*. The first arm 78*a* is attached to the folded flange 77, and has the thickness $L_1=3$ mm. The first arm 78*a* of the wave absorber closes the small gap between the cavity wall 75 and the wall 76 of the chamber. The second arm 78*b* of the wave absorber extends into the inner surface of the cavity 73** as shown in the figure.

The embodiment of FIG. 7 is effective because the wave absorber is mounted not only outside of the cavity but also inside of the cavity. As the flux density in the cavity is at peak value around the edge of the wall or the folded portion 77, the leakage flux is absorbed by the absorber, and further, the leakage flux through the gap between the walls 75 and 76 is also absorbed because the absorber 78*a* closes said gap.

It should be noted of course that when an additional absorber is mounted at another edge of the cavity (edge of the wall 75), the effect is further improved.

The material of the wave absorber 78 may be similar to that of the previous embodiments.

Figure 8:
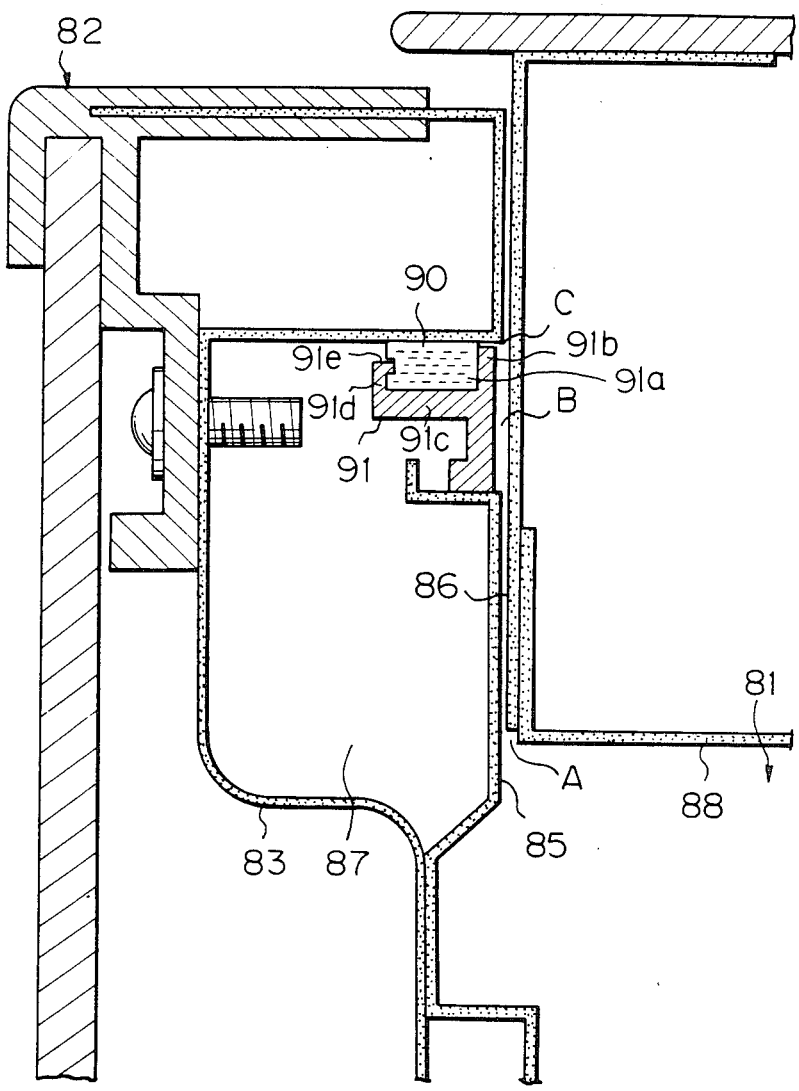
FIG. 8 and FIG. 9 show cross sections of the modification which is coupled with the previous embodiments.
Figure 9:
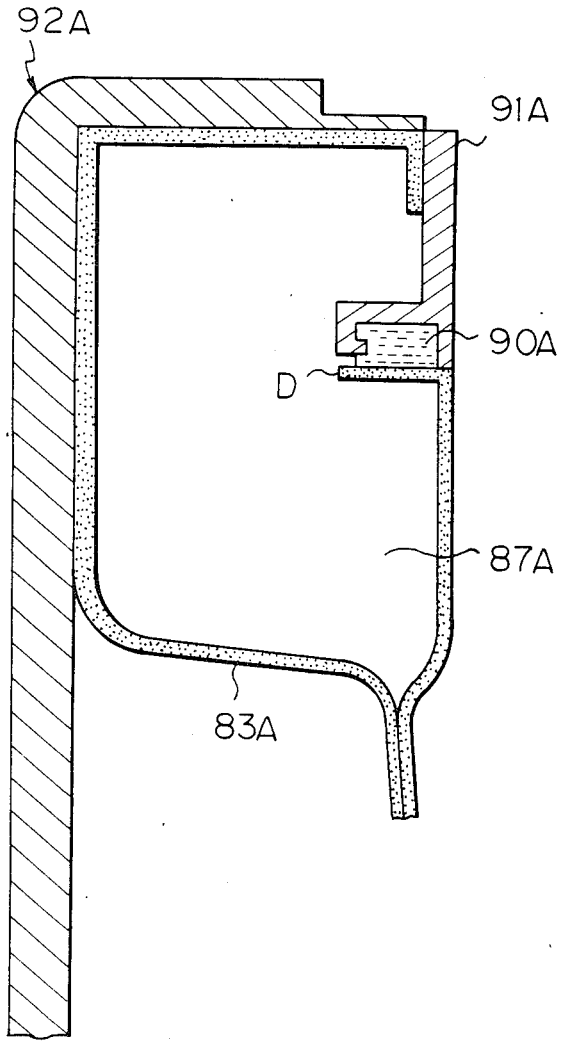

FIGS. 8 and 9 show the modification of previous embodiments, and the feature of FIGS. 8 and 9 is the integral structure of a wave absorber and dielectric cover of a cavity.

In FIG. 8, the chamber 81 of a microwave oven has a door 82 which closes the opening of the chamber 81. The door 82 has the conductive frame 83 at the peripheral portion of the door 82. The wall 85 of the frame 83 faces with the wall 86 of the chamber 81 with a small gap. The frame 83 provides a cavity 87 which resonates with the fundamental frequency (2450 MHz) of a microwave oven.

The opening or the entrance of the cavity 87 is covered with the dielectric cover 91 which is integral with the wave absorber 90. The cover 90 is made of plastics, and is fixed to the cavity 87 through for instance adhesive means. The cover 91 has a hand 91*a* at the extreme end of the cover 91, and said hand 91*a* has a first arm 91*b*, a second arm 91*b* and a third arm 91*d*. Preferably, the third arm 91*d* has a fold 91*e*. When assembled, the wave absorber 90 locates at the end of the wall of the cavity 87. Therefore, the operation of the wave absorber 90 is similar to the wave absorber 28 in FIG. 6, or the wave absorber 78*a* in FIG. 7. The numeral 85 is the wall of the cavity 87, 86 and 88 are the walls of the chamber 81. The gap between the walls 85 and 86 is the leakage path, and the leakage through said path is prevented by the present invention.

FIG. 9 is the modification of FIG. 8, and the feature of FIG. 9 is the location of a wave absorber 90A which is located at another edge D of the opening of the cavity 87A. Of course the wave absorber 90A is integral with the dielectric cover 91A which covers the opening of the cavity 87A. The numeral 83A is the frame of the cavity 87A, and 92A is the plastics decoration which covers the cavity 87A. The electrical operation of FIG. 9 is similar to that of FIG. 5.

The embodiments of FIGS. 8 and 9 are advantageous in manufacturing process. Since a dielectric cover (91, 91A) and a wave absorber (90, 90A) is half assembled first, the manufacturing process of an oven is simplified.

Figure 10:
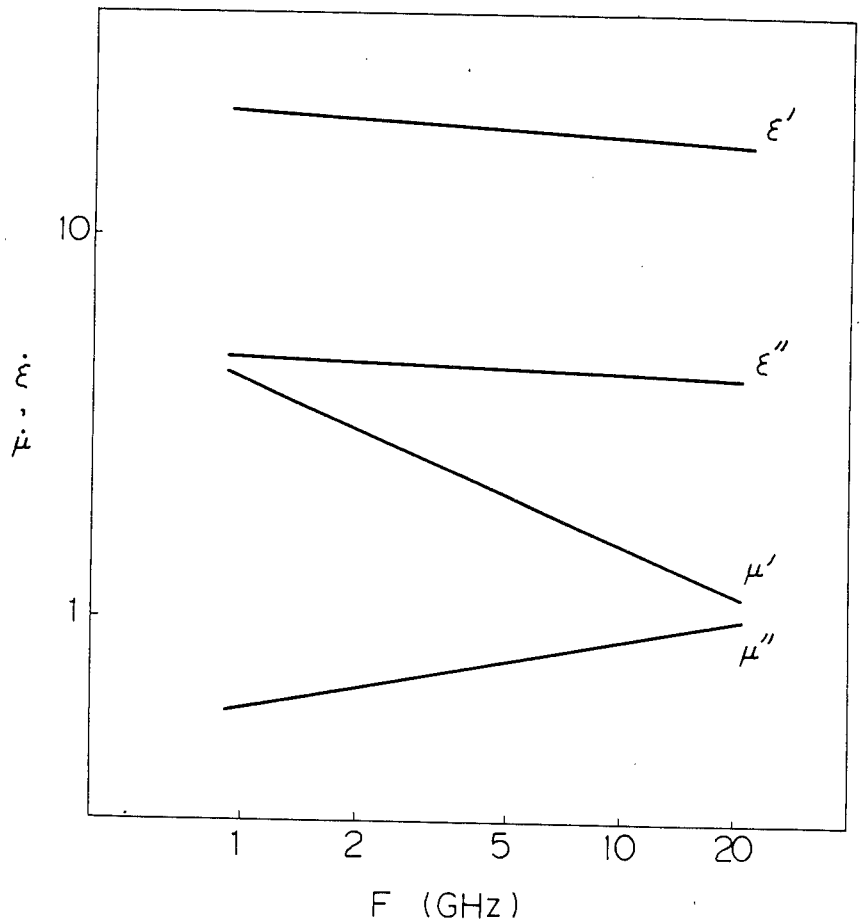
FIG. 10 shows curves of the dielectric constants and the magnetic permeability of the wave absorber in a described experiment with, FIGS. 11(*a*), 11(*b*) and 11(*c*) show the structure of the wave absorber devices experimented in the present invention, and FIGS. 12(*a*), 12(*b*) and 12(*c*) show curves of the experimented characteristics of the present invention.
Figure 11A:
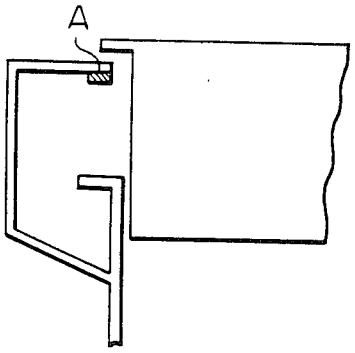
Figure 11B:
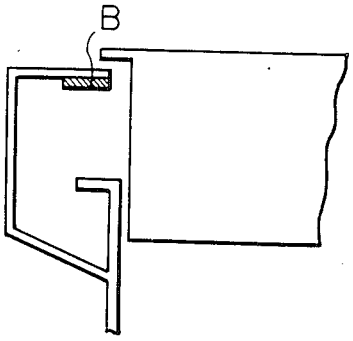
Figure 11C:
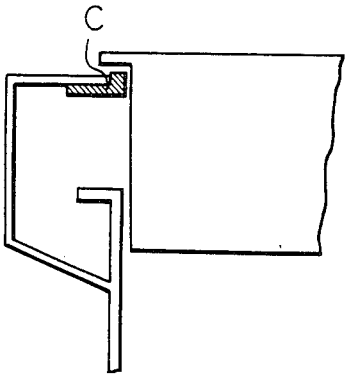
Figure 12A:
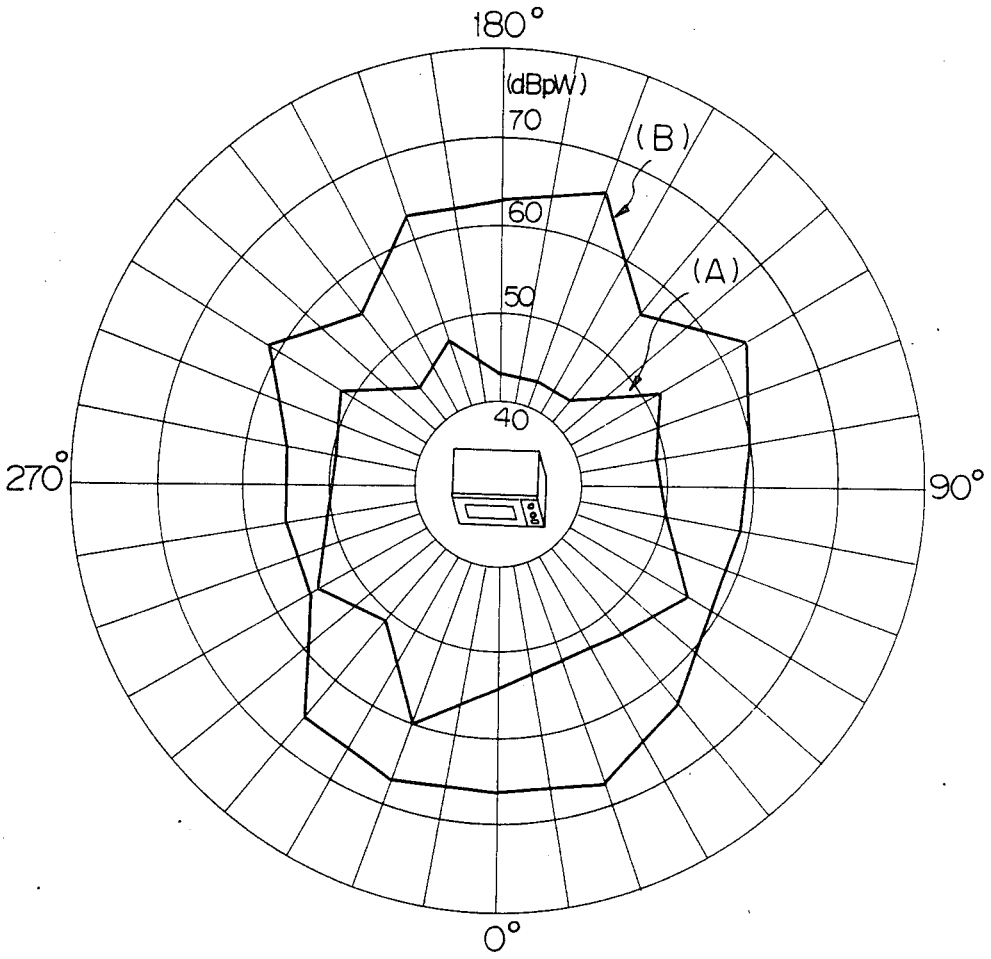
Figure 12B:
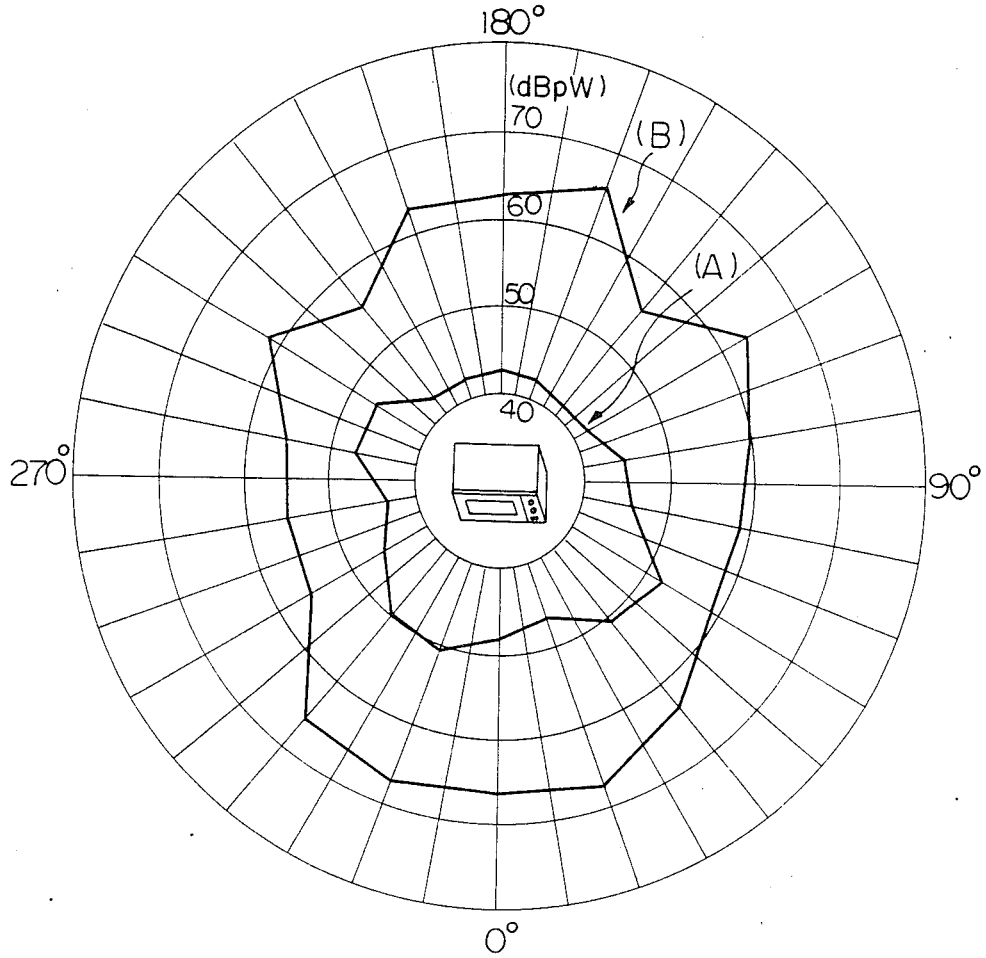
Figure 12C:
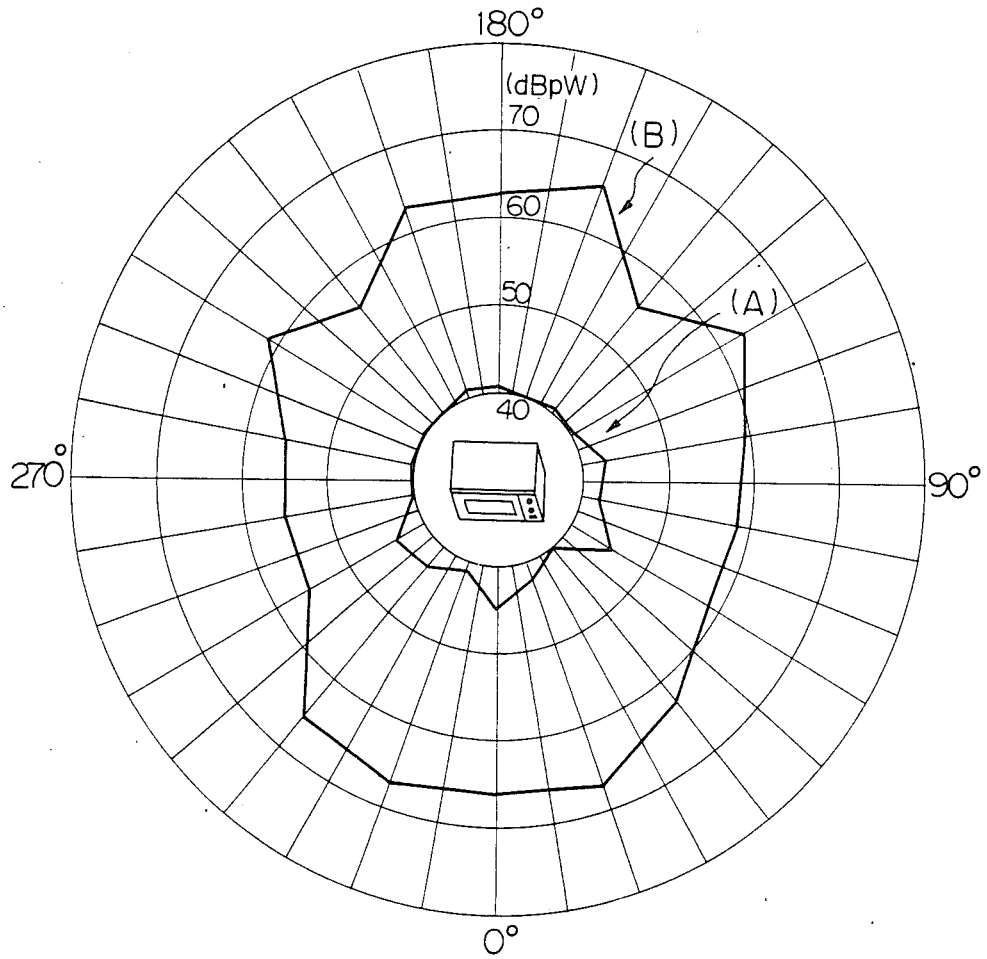

Next, some experimental results of the present invention are shown in accordance with FIGS. 10 through 12.

FIG. 10 shows the curves of the real parts of the dielectric constant $\epsilon'$ and the magnetic permeability $\mu'$, and the imaginary part of the dielectric constant $\epsilon''$ and the permeability $\mu''$ of the wave absorber which is used in the experiment ($\dot{\epsilon}=\epsilon'+j\epsilon''$, $\dot{\mu}=\mu'+\mu''$). The horizontal axis in FIG. 10 shows frequency between 1 GHz and 20 GHz.

FIGS. 11(*a*), 11(*b*) and 11(*c*) show models of the structure of a wave absorber. In FIG. 11(*a*), a wave absorber A is located at the edge of the outer wall of a cavity. In FIG. 11(*b*), a wave absorber B is located at both the edge of the outer wall of the cavity, and the inner surface of the outer wall of the cavity. In FIG. 11(*c*), a wave absorber C is located at the inner surface of the outer wall, the edge of the outer wall, and in the gap between the cavity and the chamber wall.

FIGS. 12(*a*), 12(*b*) and 12(*c*) show experimental curves. FIG. 12(*a*) is the curve resulting from the structure of FIG. 11(*a*), FIG. 12(*b*) is the curve resulting from the structure of FIG. 11(*b*), and FIG. 12(*c*) is the curve resulting from the structure of FIG. 11(*c*). In those curves of FIGS. 12(*a*) through 12(*c*), the external curves B show the data in which no wave absorber is mounted, and the inner curves A show the data in which a wave absorber is mounted. The data is taken on the horizontal plane where a microwave oven is placed around the direction of 360 degrees. The front direction is indicated by 0 degrees, and the rear direction is indicated by 180 degrees. The coplanar circles show the strength of noise power between 40 dBpW and 70 dBpW. The allowable upper limit of the noise power in the CISPR standard is 57 dBpW.

It should be appreciated that the curve of FIG. 12(*c*) is the best, and the curve of FIG. 12(*b*) is satisfactory. In the curve of FIG. 12(*a*), the noise power of the curve A is considerably decreased as compared with that of the curve B.

From the foregoing it will now be apparent that a new and improved microwave absorber device has been discovered. It should be understood of course that the embodiments disclosed are merely illustrative and are not intended to limit the scope of the invention. Reference should be made to the appended claims, therefore, rather than the specification as indicating the scope of the invention.

What is claimed is:

1. In a microwave heating apparatus having
- a chamber in which food to be cooked is put,
- a microwave generating means,
- a door for closing an opening of said chamber made of electro-magnetic shielding material,
- a choke cavity provided at peripheral portions of said door so that a opening of said choke cavity faces with a wall of the chamber, characterized in that
- said choke cavity is provided with wave absorber mounted in the opening plane of the choke cavity and extends over only a portion of the opening of the choke cavity, and
- said wave absorber is comprised of ferrite material.

2. A microwave apparatus according to claim 1, wherein said wave absorber is provided at a edge of an intermediate plate in said choke cavity.

3. A microwave apparatus according to claim 2, wherein said intermediate plate is separated into a plurality of elongated tines.

4. A microwave apparatus according to claim 1, wherein said wave absorber is provided at an edge of an outer wall of said choke cavity.

5. A microwave apparatus according to claim 4, wherein said wave absorber extends into inner surface of the choke cavity.

6. A microwave apparatus according to claim 1, wherein said wave absorber is provided at an edge of an inner wall of said choke cavity.

7. A microwave apparatus according to claim 1, wherein said wave absorber is provided at an edge of an intermediate plate and an edge of an outer wall of the choke cavity.

8. A microwave apparatus according to claim 1, wherein said wave absorber is provided at an edge of an outer wall and an edge of an inner wall of the choke cavity.

9. A microwave apparatus according to claim 1, wherein said wave absorber is integral with dielectric cover means which closes entrance of the choke cavity.

10. A microwave apparatus according to claim 9, wherein said wave absorber is adhered to the cover means which is made of plastics.

11. A microwave apparatus according to claim 1, wherein a wall of the choke cavity has a fold at an extreme end of the wall, and a wave absorber is adhered on said fold.

12. A microwave apparatus according to claim 1, wherein said wave absorber closes a gap between said choke cavity and a wall of said chamber.

13. A microwave apparatus according to claim 1 wherein said wave absorber extends over only a small fractional portion of the opening of the choke cavity.

14. A microwave apparatus according to claim 1 wherein said wave absorber is an elongated strip with a thickness in the range between 1 mm and 2 mm, and a width in the range between 6 mm and 8 mm.

15. A microwave apparatus according to claim 1 wherein said ferrite material is a ferrite powder.

* * * * *